US007228898B2

(12) United States Patent
Grigsby et al.

(10) Patent No.: US 7,228,898 B2
(45) Date of Patent: Jun. 12, 2007

(54) GRAVEL PACK COMPLETION WITH FLUID LOSS CONTROL FIBER OPTIC WET CONNECT

(75) Inventors: Tommy Grigsby, Houma, LA (US); Bruce Techentien, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 122 days.

(21) Appl. No.: 10/680,053

(22) Filed: Oct. 7, 2003

(65) Prior Publication Data

US 2005/0072564 A1 Apr. 7, 2005

(51) Int. Cl.
*E21B 17/02* (2006.01)
*G02B 6/38* (2006.01)
*H01R 4/60* (2006.01)
*H01R 33/945* (2006.01)

(52) U.S. Cl. ..... 166/242.6; 166/66; 166/242.7; 385/100; 385/138; 439/201; 439/577

(58) Field of Classification Search ..... 166/250.01, 166/66, 179, 183, 129, 188, 242.1, 242.6, 166/242.7; 385/12, 100, 138; 439/201, 439/577

See application file for complete search history.

(56) References Cited

U.S. PATENT DOCUMENTS 4,134,455 A * 1/1979 Read ..... 166/334.1
4,375,237 A 3/1983 Churchman
4,442,893 A 4/1984 Foust
4,483,584 A 11/1984 Gresty
4,624,309 A 11/1986 Schnatzmeyer
4,690,212 A 9/1987 Termohlen
4,756,595 A * 7/1988 Braun et al. ..... 385/75
4,757,859 A 7/1988 Schnatzmeyer
4,825,946 A 5/1989 Schnatzmeyer
4,828,027 A 5/1989 Schnatzmeyer
4,846,269 A 7/1989 Schnatzmeyer
4,887,883 A 12/1989 Darbut et al.
4,921,438 A 5/1990 Godfrey et al.
5,048,610 A * 9/1991 Ross et al. ..... 166/372
5,251,708 A * 10/1993 Perry et al. ..... 175/41
5,435,351 A 7/1995 Head
5,505,260 A 4/1996 Andersen et al.
5,577,925 A 11/1996 Schnatzmeyer et al.
5,645,438 A * 7/1997 Cairns ..... 439/139

(Continued)

FOREIGN PATENT DOCUMENTS

GB 2318397 4/1998

(Continued)

OTHER PUBLICATIONS

Intelligent Wells, "Optical Fiber Technology," dated Oct. 2002.

(Continued)

*Primary Examiner*—Jennifer H Gay
(74) *Attorney, Agent, or Firm*—Marlin R. Smith

(57) ABSTRACT

A gravel pack completion with fluid loss control and fiber optic wet connect. In a described embodiment, a system for completing a subterranean well includes multiple assemblies installed in a wellbore. Each assembly has a fiber optic line. The fiber optic lines are operatively connected to each other after the assemblies are installed in the wellbore.

36 Claims, 4 Drawing Sheets

U.S. PATENT DOCUMENTS

| | | | | |
|---|---|---|---|---|
| 5,645,483 | A | 7/1997 | Cushman | |
| 5,727,630 | A * | 3/1998 | Brammer | 166/355 |
| 5,778,978 | A * | 7/1998 | Crow | 166/254.2 |
| 5,803,167 | A | 9/1998 | Bussear et al. | |
| 5,831,156 | A * | 11/1998 | Mullins | 73/152.18 |
| 5,947,198 | A * | 9/1999 | McKee et al. | 166/66.4 |
| 6,006,828 | A | 12/1999 | Kluth et al. | |
| 6,017,227 | A * | 1/2000 | Cairns et al. | 439/138 |
| 6,062,073 | A * | 5/2000 | Patton et al. | 73/152.28 |
| 6,152,608 | A | 11/2000 | Ghara et al. | |
| 6,186,229 | B1 * | 2/2001 | Martin et al. | 166/250.08 |
| 6,281,489 | B1 | 8/2001 | Tubel et al. | |
| 6,302,203 | B1 * | 10/2001 | Rayssiguier et al. | 166/250.01 |
| 6,325,146 | B1 | 12/2001 | Ringgenberg et al. | |
| 6,332,787 | B1 | 12/2001 | Barlow et al. | |
| 6,349,770 | B1 * | 2/2002 | Brooks et al. | 166/383 |
| 6,378,610 | B2 * | 4/2002 | Rayssiguier et al. | 166/281 |
| 6,439,778 | B1 | 8/2002 | Cairns | |
| 6,464,405 | B2 | 10/2002 | Cairns et al. | |
| 6,478,091 | B1 | 11/2002 | Gano | |
| 6,527,052 | B2 | 3/2003 | Ringgenberg et al. | |
| 6,568,481 | B2 * | 5/2003 | Koehler et al. | 166/385 |
| 6,666,274 | B2 * | 12/2003 | Hughes | 166/385 |
| 6,684,950 | B2 * | 2/2004 | Patel | 166/250.01 |
| 6,736,545 | B2 * | 5/2004 | Cairns et al. | 385/56 |
| 6,758,271 | B1 | 7/2004 | Smith | |
| 6,758,272 | B2 * | 7/2004 | Bixenman et al. | 166/255.1 |
| 6,766,853 | B2 * | 7/2004 | Restarick et al. | 166/242.6 |
| 6,776,636 | B1 | 8/2004 | Cameron et al. | |
| 6,837,310 | B2 | 1/2005 | Martin | |
| 6,874,361 | B1 | 4/2005 | Meltz et al. | |
| 6,933,491 | B2 | 8/2005 | Maida et al. | |
| 6,951,252 | B2 | 10/2005 | Restarick | |
| 6,983,796 | B2 | 1/2006 | Bayne et al. | |
| 2002/0007970 | A1 * | 1/2002 | Terry et al. | 175/92 |
| 2002/0014340 | A1 * | 2/2002 | Johnson | 166/380 |
| 2002/0125008 | A1 * | 9/2002 | Wetzel et al. | 166/278 |
| 2002/0162666 | A1 | 11/2002 | Koehler et al. | |
| 2003/0066643 | A1 * | 4/2003 | Ringgenberg et al. | 166/250.01 |
| 2003/0081917 | A1 * | 5/2003 | Bussear | 385/101 |
| 2003/0131990 | A1 * | 7/2003 | Tubel et al. | 166/250.01 |
| 2003/0141075 | A1 | 7/2003 | Bixenman et al. | |
| 2003/0173077 | A1 * | 9/2003 | Smith et al. | 166/242.6 |
| 2003/0192708 | A1 * | 10/2003 | Koehler et al. | 166/385 |
| 2003/0196820 | A1 | 10/2003 | Patel | |
| 2003/0213598 | A1 * | 11/2003 | Hughes | 166/380 |
| 2004/0065439 | A1 | 4/2004 | Tubel et al. | |
| 2004/0067002 | A1 * | 4/2004 | Berg et al. | 385/12 |
| 2004/0173350 | A1 * | 9/2004 | Wetzel et al. | 166/253.1 |
| 2004/0256127 | A1 | 12/2004 | Brenner et al. | |
| 2004/0256137 | A1 | 12/2004 | Bertini et al. | |
| 2005/0092501 | A1 | 5/2005 | Chavers et al. | |
| 2005/0109518 | A1 | 5/2005 | Blacklaw | |

FOREIGN PATENT DOCUMENTS

| | | |
|---|---|---|
| WO | WO 86/02173 | 4/1986 |
| WO | WO 03/046428 | 6/2003 |

OTHER PUBLICATIONS

Intelligent Wells, "Oil Field Applications of Hydroptics Technology," dated Oct. 2002.
World Oil, "World's First Multiple Fiber-Optic Intelligent Well," dated Mar. 2003.
Underwater Magazine, "Underwater Mateable Connectors in the Military and Telecom Sectors," dated Sep./Oct. 2002.
Sea Technology, "The Ruggedization of Hybrid Wet-Mate Connectors," dated Jul. 2000.
Sea Technology, "Optical Fiber and Connectors: Critical for Future Subsea Systems," undated.
OTC 15323, "The Development and Application of HT/HP Fiber-Optic Connectors for Use on Subsea Intelligent Wells," dated 2003.
Journal of Petroleum Technology, "Development of HP/HT Fiber-Optic Connectors for Subsea Intelligent Wells," dated Aug. 2003.
Sea Technology, "Hybrid Wet-Mate Connectors: 'Writing the Next Chapter'," dated Jul. 1997.
Tronic, "Tronic Fibre Optic Wellhead Feedthrough Connectors," undated.
Tronic, "Firefly Project," undated.
OTC 13235, "Extending Tieback Distances: Wet-Mate Connectors, Enabling Technologies for Critical Systems Developments," dated 2001.
Ocean Design, "Underwater Mateable Connectors: Enabling Technology and the Next Step in Performance for Navy and Telecom Applications," Presented at Underwater Intervention Conference, 2002.
W Magazine, "Intelligent Well Completion, the Next Steps," dated Sep. 2002.
Production Optimization, "Intelligent Completions," undated.
Seacon, "Microstar, 4-Channel, Wet-Mate, Optical Connector," undated.
Ocean Design, Inc., "Ocean Design Introduces New I-CONN Product Line," dated Jul. 22, 2002.
Weatherford, "Intelligent Well Briefing," dated May 14, 2003.
"Pioneering Fibre Optic Completion Installation in the Mahogany Field, Offshore Trinidad," undated.
Pes, "Model Fo Fibre Optic Orientating Disconnect Head," dated Oct. 23, 2000.
SPE 71676, "The Use of Fiber-Optic Distributed Temperature Sensing and Remote Hydraulically Operated Interval Control Valves for the Management of Water Production in the Douglas Field," dated 2001.
SPE 84324, "Brunei Field Trial of a Fibre Optic Distributed Temperature Sensor (DTS) System in a 1,000 m Open Hole Horizontal Oil Producer," dated 2003.
Halliburton, "X-Line® and R-Line® Landing Nipples and Lock Mandrels; Set and Lock Reliability in Subsurface Flow Control Equipment with a Total Completion Package", dated Mar. 1997.
Focal Technologies Corporation, Product Brochure for Model 286, dated Apr. 15, 2003.
U.S. Appl. No. 10/828,085, filed Apr. 20, 2004.
U.S. Appl. No. 10/680,625, filed Oct. 7, 2003.
U.S. Appl. No. 10/680,440, filed Oct. 7, 2003.
U.S. Appl. No. 10/790,908, filed Mar. 2, 2004.
The Expro Group brochure, "Tronic Fibre Optic Wellhead Feedthrough Connectors", undated.
Seacon brochure, "Fiber Optic Connectors", undated.
Ocean Design, Inc. brochure, "NRH Connector", undated.
Ocean Design, Inc. brochure, "Hybrid Wet-Mate", 2000.
Ocean Design, Inc. brochure, "I-CONN; West-Mateable Optical Connector", 2000.
Seacon Advanced Products data sheets, pp. 22-1 through 22-20.
Office Action for U.S. Appl. No. 10/680,625 dated Jan. 26, 2005.
Otis Engineering drawing No. 41UP58701 dated May 4, 1993.
Halliburton Energy Services drawing No. 42 oo 210 dated Apr. 7, 2001.
Search Report for PCT/US04/01863.
Search Report for PCT/US04/01856.
U.S. Appl. No. 10/873,849 filed Jun. 22, 2004.
Norfolk Wire & Electronics, "Optical Fiber Splice Protectors—FSP", dated 2003.
Office Action for U.S. Appl. No. 10/680,625, dated Jun. 27, 2005.
Office Action for U.S. Appl. No. 10/680,440, dated Jul. 6, 2005.
Halliburton presentation entitled, "DTS Conceptual Completions", Dec. 3, 2002.
Halliburton presentation entitled, "Greater Plutonio Completions Workshop", Mar. 12, 2003.
Office Action for U.S. Appl. No. 11/038,369, dated Feb. 14, 2006.
Office Action for U.S. Appl. No. 10/680,625, dated Mar. 9, 2006.
Office Action for U.S. Appl. No. 10/680,440, dated Jan. 13, 2006.
Office Action for U.S. Appl. No. 10/790,908, dated Mar. 14, 2006.
Office Action for U.S. Appl. No. 10/828,085, dated Mar. 22, 2006.

International Preliminary Report on Patentability for PCT/US2004/001863.
International Preliminary Report on Patentability for PCT/US2004/001856.
International Preliminary Report on Patentability for PCT/US2004/001857.
Written Opinion for PCT/US2004/001863.
Written Opinion for PCT/US2004/001856.
Written Opinion for PCT/US2004/001857.
Office Action for U.S. Appl. No. 10/873,849, dated May 5, 2006.
Office Action for U.S. Appl. No. 10/680,440, dated Jul. 5, 2006.
Office Action for U.S. Appl. No. 11/038,369, dated Jul. 11, 2006.
Search Report for United Kingdom application No. GB 0507890.2.
International Search Report for PCT/US04/01857.

* cited by examiner

GRAVEL PACK COMPLETION WITH FLUID LOSS CONTROL FIBER OPTIC WET CONNECT

CROSS-REFERENCE TO RELATED APPLICATIONS

The present application is related to the following copending applications: application Ser. No. 10/680,625 filed Oct. 7, 2003; and application Ser. No. 10/680,440 filed Oct. 7, 2003. The entire disclosures of these related applications are incorporated herein by this reference.

BACKGROUND

The present invention relates generally to operations performed and equipment utilized in conjunction with subterranean wells and, in an embodiment described herein, more particularly provides a gravel pack completion with fluid loss control and fiber optic wet connect.

While it is known to install a fiber optic line in a well completion, for example, to sense and monitor well parameters such as pressure and temperature in the completion, it has proven difficult to install the fiber optic line with the completion. In one system, a tube is strapped to the outside of a completion string as the string is installed in the well. The fiber optic line is then pumped down through the tube. In another system, the fiber optic line is contained in the tube or other protective sheathing as the completion string is installed in the well.

Unfortunately, such systems do not permit fiber optic connections to be made after the completion string is installed. In many situations, it may be desirable to install a completion in sections, such as when separately gravel packing intervals in a horizontal or highly deviated wellbore. In such situations, it would be beneficial to be able to connect fiber optic lines installed with the separate gravel packed sections. It would also be beneficial to be able to utilize fluid loss control devices with the separate gravel packed sections, and to utilize a travel joint for spacing out the completion string below a tubing hanger, for example.

SUMMARY

In carrying out the principles of the present invention, in accordance with an embodiment thereof, a gravel pack completion system is provided which permits fiber optic lines separately installed in a wellbore to be connected to each other as corresponding separate assemblies of the completion system are installed in the wellbore.

In one aspect of the invention, a system for completing a subterranean well is provided. The system includes multiple assemblies installed in a wellbore. Each of the assemblies includes a fiber optic line. The fiber optic lines are operatively connected to each other after the assemblies are installed in the wellbore.

In another aspect of the invention, a completion system is provided which includes a longitudinally telescoping travel joint. A fiber optic line extends longitudinally through the travel joint.

In yet another aspect of the invention, a system for completing a subterranean well includes a gravel packing assembly having a fiber optic connector, and a seal assembly having another fiber optic connector. The seal assembly is oriented relative to the gravel packing assembly, thereby aligning the fiber optic connectors, when the seal assembly is engaged with the gravel packing assembly in the well.

In a further aspect of the invention, a system for completing a subterranean well includes an assembly installed in a wellbore. The assembly includes a fluid loss control device and a fiber optic line. Another assembly having a fiber optic line is installed in the wellbore and engaged with the first assembly. The fluid loss control device permits flow through the device, and the fiber optic lines are operatively connected to each other, in response to engagement between the assemblies in the wellbore.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1:
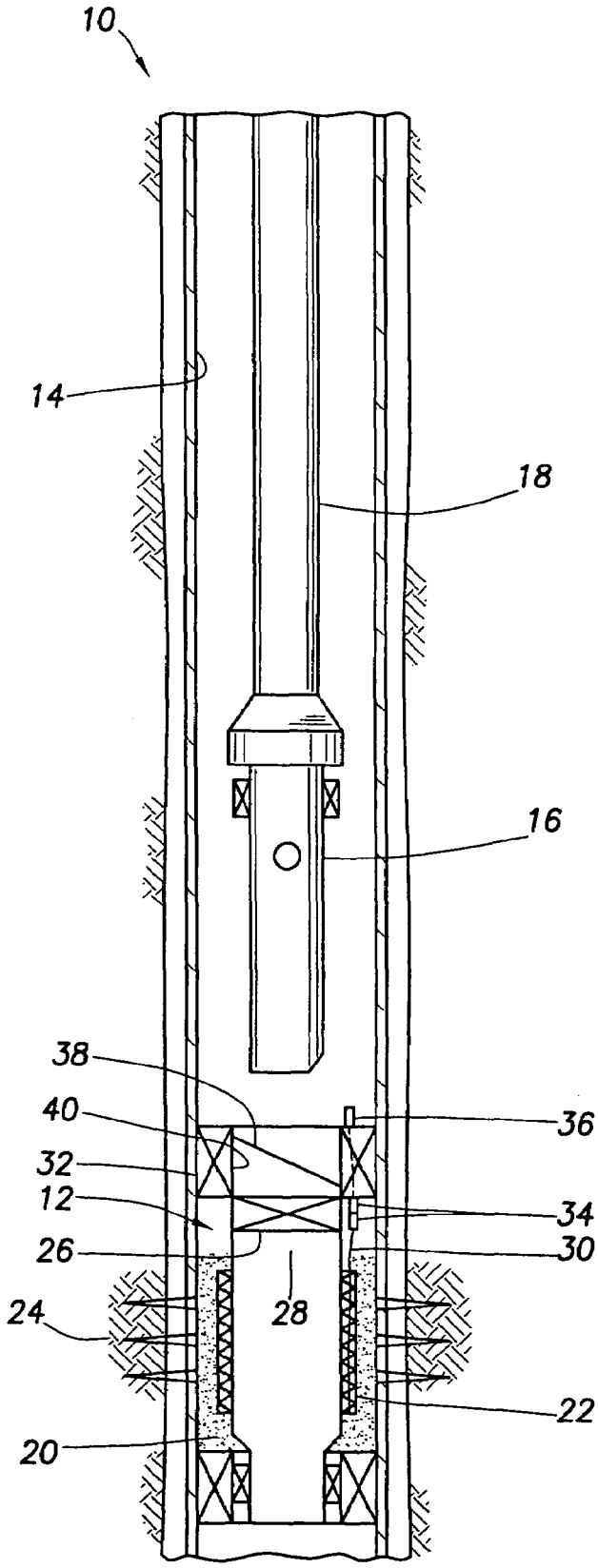
FIGS. 1-3 are schematic partially cross-sectional views of a system and method embodying principles of the present invention.
Figure 2:
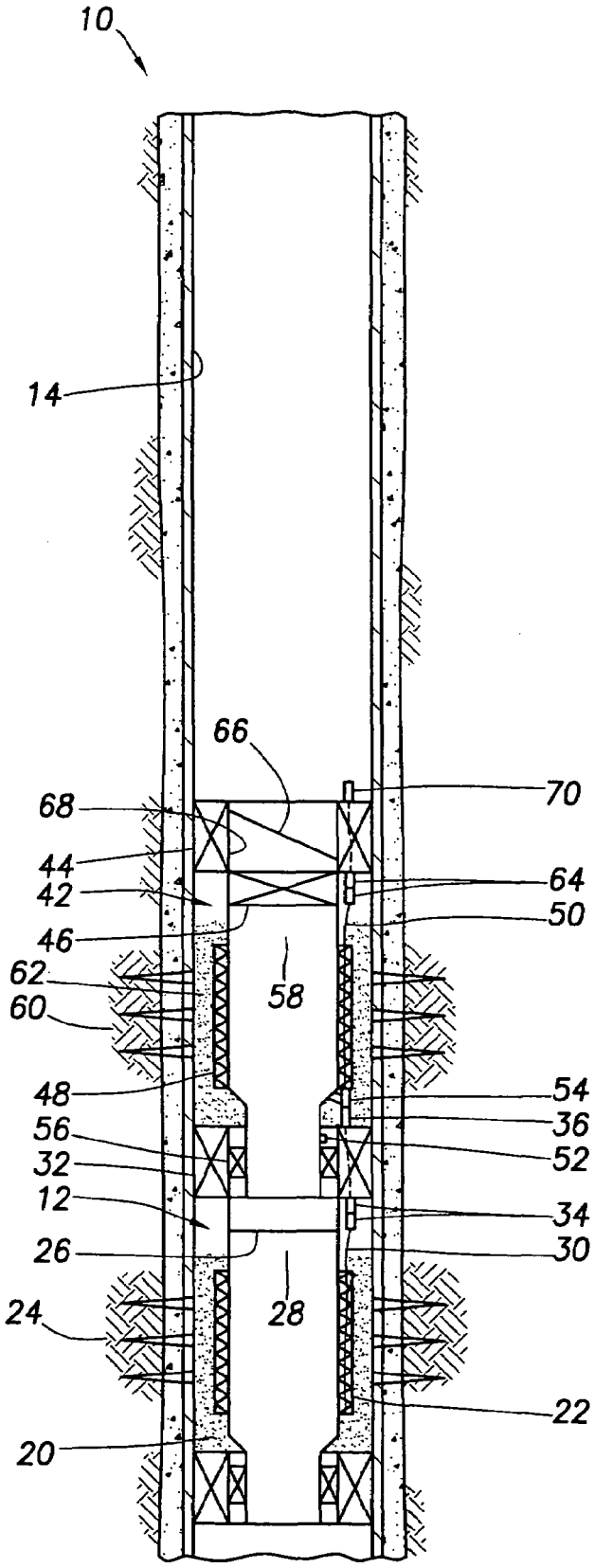
Figure 3:
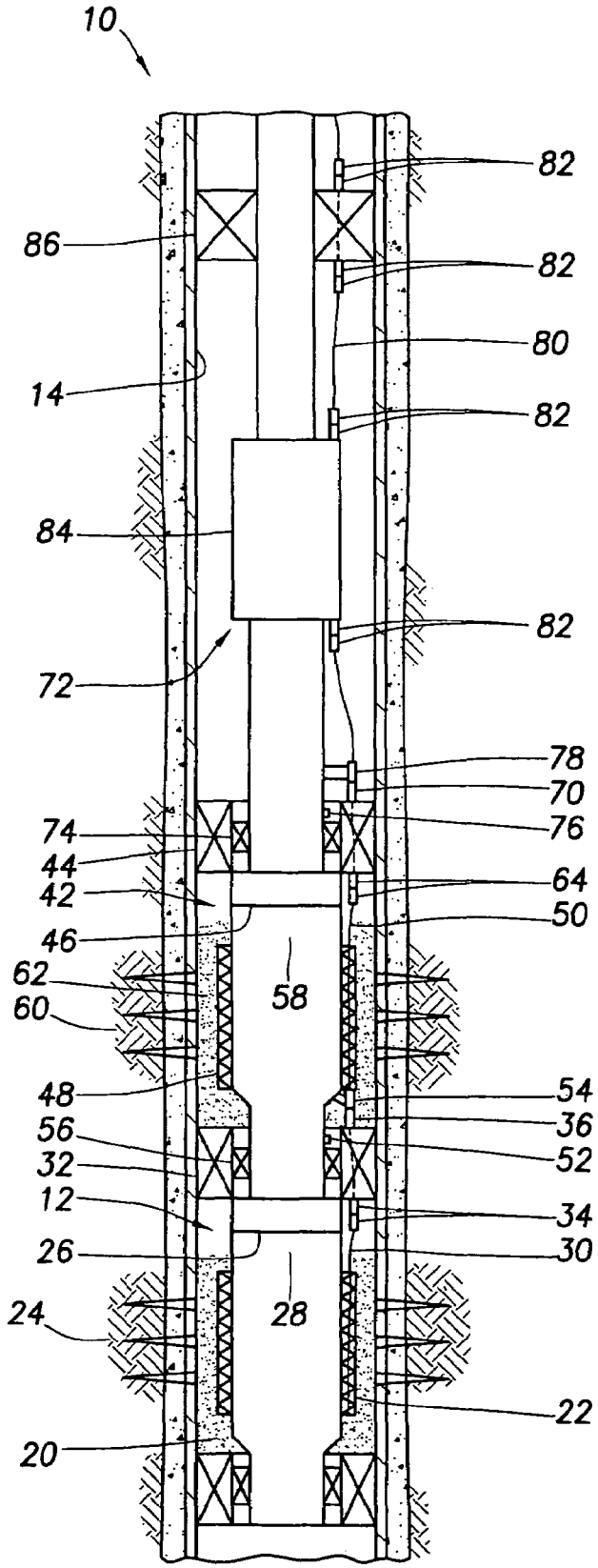

Representatively illustrated in FIGS. 1-3 is a system and method 10 for completing a subterranean well which embodies principles of the present invention. In the following description of the system 10 and other apparatus and methods described herein, directional terms, such as "above", "below", "upper", "lower", etc., are used only for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention.

As depicted in FIG. 1, a gravel packing assembly 12 is installed in a wellbore 14. The wellbore 14 may be cased as shown in FIG. 1, or the wellbore may be uncased. All or part of the gravel packing assembly 12 may be installed in an uncased portion of the wellbore 14. A service tool 16 conveyed on a work string 18 is used to install the gravel packing assembly 12, and to flow gravel 20 into an annulus formed between a well screen 22 and the wellbore 14.

Note that, although a gravel packed completion is described herein as incorporating principles of the invention, the invention is not limited to gravel packed completions or any other type of completions, nor is the invention limited to any particular detail of the completion system 10 described herein. Instead, the principles of the invention have a wide variety of possible applications, and the system 10 is described merely to illustrate an example of the benefits which may be derived from the invention.

To prevent loss of well fluid into a formation or zone 24 intersected by the wellbore 14, a fluid loss control device 26 is included in the assembly 12. Preferably, the device 26 is actuated to prevent flow through a longitudinal passage 28 of the assembly 12 when the service tool 16 is retrieved from within the assembly. This operates to prevent well fluid from flowing into the formation 24. When actuated by retrieval of the service tool 16, the device 26 may permit one-way flow through the device (e.g., upward flow through the passage 28 as depicted in FIG. 1) in the manner of a check valve, but the device prevents flow in at least one direction through the device (e.g., downward flow through the passage as depicted in FIG. 1).

The assembly 12 further includes a fiber optic line 30. The fiber optic line 30 extends longitudinally through the screen 22, and through a gravel pack packer 32 of the assembly 12. In the embodiment depicted in FIG. 1, the fiber optic line 30 extends longitudinally through a sidewall of the screen 22, and through a sidewall of the packer 32.

Preferably, the fiber optic line 30 is installed on the assembly 12 as it is run into the wellbore 14, for example, by strapping it to the assembly. To facilitate passage of the fiber optic line 30 through the packer 32, fiber optic connectors 34 may be used to operatively connect a lower portion of the fiber optic line to another portion of the fiber optic line extending through the packer.

These connectors 34 may be connected at the surface, for example, when the packer 32 is made up to the rest of the assembly 12, and so the connectors would be known to those skilled in the art as making a "dry" connection. Connectors which are operatively connected in the wellbore 14 would be known to those skilled in the art as making a "wet" connection, since the connection would be made while submerged in well fluid.

As used herein, the term "fiber optic connector" is used to indicate a connector which is operably coupled to a fiber optic line so that, when one fiber optic connector is connected to another fiber optic connector, light may be transmitted from one fiber optic line to another fiber optic line. Thus, each fiber optic connector has a fiber optic line operably coupled thereto, and the fiber optic lines are connected for light transmission therebetween when the connectors are connected to each other.

Another fiber optic connector 36 is operably coupled to the fiber optic line 30 above the packer 32. Associated with the packer 32 is an orienting device 38, depicted in FIG. 1 as including a helically extending profile. The orienting device is used to align the fiber optic connector 36 with another connector as described below in relation to FIG. 2.

Also associated with the packer 32 is a seal bore 40. The seal bore 40 could be formed directly on the packer 32, or it may be separately attached to the packer, such as a polished bore receptacle. Similarly, the orienting device 38 could be formed on the packer 32 or separately attached thereto.

As depicted in FIG. 2, another gravel packing assembly 42 is installed in the wellbore 14. All or part of the gravel packing assembly 42 may be positioned in a cased or uncased portion of the wellbore 14.

The assembly 42 is similar in many respects to the assembly 12, in that it includes a gravel pack packer 44, a fluid loss control device 46, a well screen 48 and a fiber optic line 50. In a unique aspect of the invention, the fiber optic line 50 is operatively connected to the fiber optic line 30 in the wellbore (thus making a "wet" connection) when the assembly 42 is engaged with the assembly 12.

The assembly 42 includes an orienting device 52 near a lower end thereof. The orienting device 52 is depicted in FIG. 2 as a lug which engages the orienting device 38 helical profile to rotationally orient the assemblies 12, 42 relative to each other. Specifically, engagement between the orienting devices 38, 52 will cause the assembly 42 to rotate to a position in which the fiber optic connector 36 on the assembly 12 is aligned with another fiber optic connector 54 on the assembly 42. At this point, the connectors 36, 54 are operatively connected, which connects the fiber optic lines 30, 50.

Seals 56 carried on the assembly 42 sealingly engage the seal bore 40 of the assembly 12, thereby interconnecting the passage 28 to a similar longitudinal passage 58 formed through the assembly 42. The fluid loss control device 26 may be opened in response to engagement between the assemblies 12, 42, and so the passages 28, 58 are in communication with each other. Note that the fluid loss control device 26 can be opened before, during or after engagement between the assemblies 12, 42.

However, the fluid loss control device 46 is actuated to its closed configuration (preventing at least downward flow through the device in the passage 58) in response to retrieval of a gravel packing service tool, such as the tool 16 described above, from within the assembly 42. The fluid loss control device 46 may be a Model FSO device available from Halliburton Energy Services of Houston, Tex., in which case the device may prevent both upward and downward flow (i.e., in each direction through the device) when closed. Thus, as depicted in FIG. 2, the fluid loss control device 46 prevents loss of well fluid into a formation or zone 60 intersected by the wellbore 14 (and into the formation or zone 24) after gravel 62 is flowed into the annulus between the screen 48 and the wellbore.

The fiber optic line 50 is similar to the fiber optic line 30 in that it preferably extends longitudinally through sidewalls of the screen 48 and packer 44. To facilitate interconnection of the packer 44 to the remainder of the assembly 42 and provision of the fiber optic line 50 in the packer, the assembly may include "dry" fiber optic connectors 64 between upper and lower portions of the fiber optic line.

Although only two of the gravel packing assemblies 12, 42 are described as being installed in the wellbore 14 and engaged with each other downhole, it will be readily appreciated that any number of assemblies (whether or not they are specifically gravel packing assemblies) may be installed as desired. As with the assembly 12, the assembly 42 includes an upper orienting device 66, a seal bore 68 and a fiber optic connector 70 operably coupled to the fiber optic line 50, so that another gravel packing assembly (or other type of assembly) may be engaged therewith in the wellbore 14.

In FIG. 3, a production tubing string assembly is depicted engaged with the upper gravel packing assembly 42. At its lower end, the assembly 72 includes seals 74 engaged in the seal bore 68, an orienting device 76 engaged with the orienting device 66, and a fiber optic connector 78 engaged with the upper fiber optic connector 70 of the assembly 42. Engagement between the assemblies 42, 72 opens the fluid loss control device 46, so that it permits flow through the device in the passage 46.

Engagement between the orienting devices 66, 76 rotationally orients the assemblies 42, 72 relative to each other, so that the fiber optic connectors 70, 78 are aligned with each other. Operative connection between the fiber optic connectors 70, 78 in the wellbore 14 forms a "wet" connection.

The fiber optic connector 78 is operably coupled to a fiber optic line 80 extending to a remote location, such as the earth's surface or another location in the well. The fiber optic line 80 may be divided into separate portions to facilitate running the assembly 72 into the wellbore. For example, "dry" connectors 82 may be used above and below various components of the assembly 72, so that the components may be conveniently interconnected in the assembly as it is made up at the surface.

As depicted in FIG. 3, the fiber optic connectors 82 are used above and below each of a telescoping travel joint 84 and a packer 86. The fiber optic line 80 extends longitudinally through a sidewall of each of the travel joint 84 and the packer 86. The travel joint 84 is used to permit convenient spacing out of the assembly 72 with respect to a tubing hanger (not shown). The packer 86 anchors the assembly 72 in the wellbore 14 and isolates the annulus above from the completion below the packer.

Figure 4:
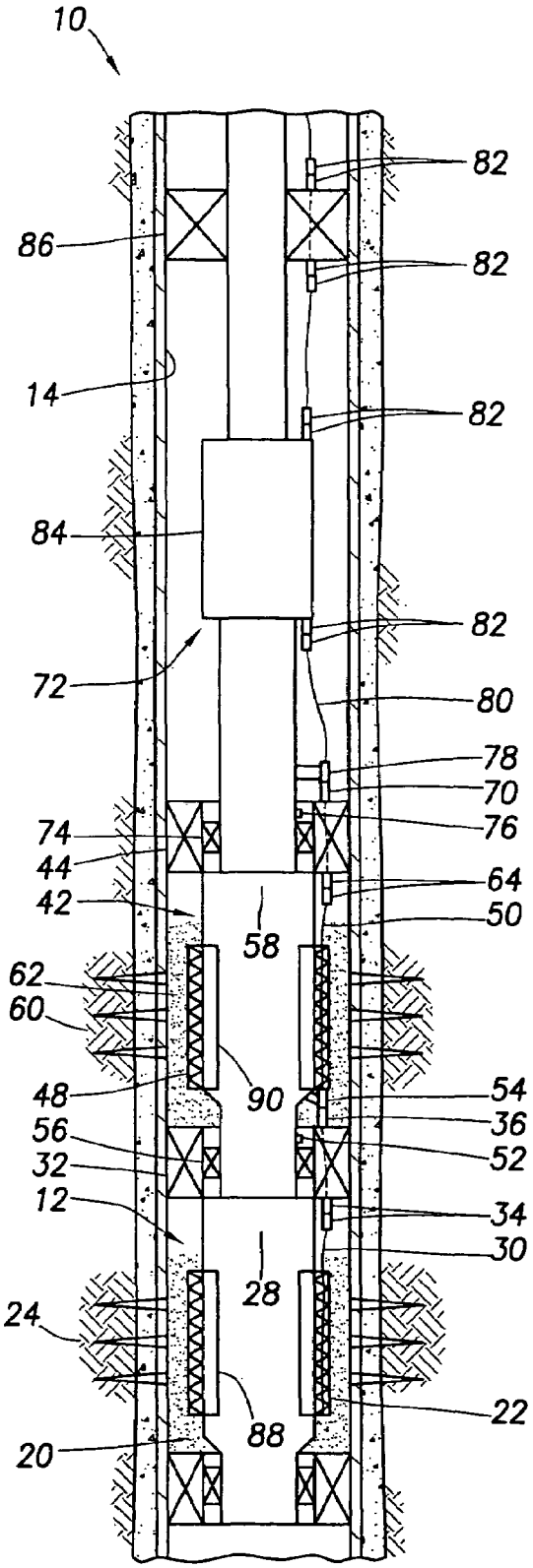
FIG. 4 is schematic partially cross-sectional view of the system and method of FIG. 1, wherein an alternate fluid loss control device is utilized.

In FIG. 4 an alternate configuration of the system 10 is representatively illustrated. This alternate configuration is similar in most respects to the system 10 depicted in FIGS. 1-3, except that the fluid loss control devices 26, 46 are not used. Instead, fluid loss control devices 88, go are used in the respective screens 22, 48.

The fluid loss control devices 88, go are of the type which permit one-way flow through the devices. The device 88 permits flow from the wellbore 14, through the screen 22 and into the passage 28, but prevents outward flow through the screen, in the manner of a check valve. Similarly, the device go permits flow inward through the screen 48 from the wellbore 14 to the passage 58, but prevents outward flow through the screen.

Figure 5:
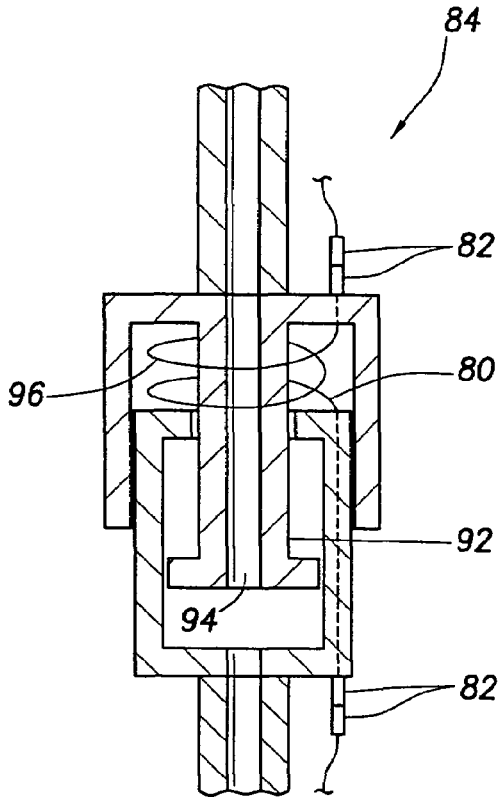
FIG. 5 is a schematic partially cross-sectional view of a travel joint embodying principles of the present invention.

In FIG. 5 a schematic cross-sectional view of the travel joint 84 is depicted. In this view the manner in which the fiber optic line 80 extends through a sidewall of the travel joint 84 may be seen. Preferably, the fiber optic line 80 is wrapped about a mandrel 92 through which a longitudinal flow passage 94 of the travel joint 84 extends.

Thus, a coil 96 of the fiber optic line 80 is contained in the travel joint 84 sidewall. The coil 96 permits the length of the fiber optic line 80 to vary to accommodate changes in the travel joint 84 length. Note that it is not necessary for the coil 96 to extend about the passage 94, since it could instead be positioned on one lateral side of the mandrel 92 in the sidewall of the travel joint 84, if desired.

Preferably, the coil 96 of the fiber optic line 80 has a radius of curvature of at least approximately two inches in order to ensure satisfactory transmission of optical signals through the fiber optic line. The coil 96 more preferably has a radius of curvature of at least approximately three inches.

Of course, a person skilled in the art would, upon a careful consideration of the above description of representative embodiments of the invention, readily appreciate that many modifications, additions, substitutions, deletions, and other changes may be made to these specific embodiments, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. A system for completing a subterranean well, the system comprising:

a first assembly installed in a wellbore, the first assembly including a first fiber optic line;

a second assembly installed in the wellbore, the second assembly including a second fiber optic line; and the first and second fiber optic lines being operatively connected to each other after the first and second assemblies are installed in the wellbore, wherein each of the first and second assemblies includes an orienting device, wherein each of the first and second fiber optic lines has a fiber optic connector operably coupled thereto, and wherein the orienting devices align the fiber optic connectors with each other when the first and second assemblies are engaged with each other in the wellbore.

2. The system according to claim 1, wherein the second assembly includes a travel joint having the second fiber optic line extending through the travel joint.

3. The system according to claim 2, wherein the second fiber optic line extends longitudinally through a sidewall of the travel joint.

4. The system according to claim 1, wherein the first assembly includes a fluid loss control device which prevents flow through the device until the second assembly is engaged with the first assembly.

5. The system according to claim 4, wherein the fluid loss control device is a valve which selectively prevents and permits flow through a longitudinal passage of the first assembly in communication with the wellbore external to the first assembly.

6. The system according to claim 4, wherein the fluid loss control device is a valve which selectively permits and prevents flow between a longitudinal passage of the first assembly and the wellbore external to the first assembly through a well screen of the first assembly.

7. The system according to claim 4, wherein the fluid loss control device is actuated to prevent flow through the device in response removing a service tool from the first assembly.

8. The system according to claim 4, wherein the fluid loss control device permits one-way flow through the device.

9. The system according to claim 1, wherein the first assembly includes a well screen and a packer, the first fiber optic line extending longitudinally through each of the well screen and the packer.

10. A system for completing a subterranean well, the system comprising:

a longitudinally extendable and compressible travel joint disposed in a subterranean well and configured for interconnection in a tubular string therein; and a fiber optic line extending longitudinally and internally through the travel joint.

11. The system according to claim 10, wherein the fiber optic line extends between first and second fiber optic connectors of the travel joint.

12. A system for completing a subterranean well, the system comprising:

a longitudinally extendable and compressible travel joint configured for interconnection in a tubular string; and a fiber optic line extending longitudinally and internally through the travel joint, the fiber optic line extending through a sidewall of the travel joint.

13. The system according to claim 12, wherein the fiber optic line is coiled in the travel joint sidewall.

14. A system for completing a subterranean well, the system comprising:

a longitudinally extendable and compressible travel joint configured for interconnection in a tubular string; and a fiber optic line extending longitudinally and internally through the travel joint, the fiber optic line being coiled about a passage formed longitudinally through the travel joint.

15. A system for completing a subterranean well, the system comprising:

a longitudinally extendable and compressible travel joint configured for interconnection in a tubular string; and a fiber optic line extending longitudinally and internally through the travel joint, the fiber optic line extending between first and second fiber optic connectors of the travel joint, and each of the first and second fiber optic connectors being operatively connected to respective third and fourth fiber optic connectors as the travel joint is interconnected in the tubular string being installed in the wellbore.

16. A system for completing a subterranean well, the system comprising:

a longitudinally extendable and compressible travel joint configured for interconnection in a tubular string; and a fiber optic line extending longitudinally and internally through the travel joint, the fiber optic line having a radius of curvature within the travel joint of at least approximately two inches.

17. A system for completing a subterranean well, the system comprising:

a longitudinally extendable and compressible travel joint configured for interconnection in a tubular string; and a fiber optic line extending longitudinally and internally through the travel joint, the fiber optic line having a radius of curvature within the travel joint of at least approximately three inches.

18. A system for completing a subterranean well, the system comprising:

a gravel packing assembly including a first fiber optic connector; and a seal assembly including a second fiber optic connector, the seal assembly being oriented relative to the gravel packing assembly, thereby aligning the first and second fiber optic connectors, when the seal assembly is engaged with the gravel packing assembly in the well, wherein each of the gravel packing assembly and the seal assembly includes an orienting device, the orienting devices rotationally orienting the seal assembly relative to the gravel packing assembly when the seal assembly is engaged with the gravel packing assembly.

19. The system according to claim 18, wherein the orienting devices comprise an orienting profile and a lug, the lug engaging the orienting profile, thereby causing relative rotational displacement between the gravel packing assembly and the seal assembly.

20. The system according to claim 18, wherein the gravel packing assembly includes a fluid loss control device which selectively permits and prevents flow through the device.

21. The system according to claim 20, wherein the fluid loss control device is actuated in response to engagement between the seal assembly and the gravel packing assembly.

22. The system according to claim 18, wherein the gravel packing assembly includes a well screen and a fiber optic line operably coupled to the first fiber optic connector, the first fiber optic line extending longitudinally relative to the well screen.

23. The system according to claim 22, wherein the fiber optic line extends longitudinally within a sidewall of the well screen.

24. The system according to claim 18, wherein the seal assembly is connected to a travel joint having a third fiber optic line extending through the travel joint.

25. The system according to claim 24, wherein the third fiber optic line extends longitudinally within a sidewall of the travel joint.

26. The system according to claim 24, wherein the third fiber optic line is wrapped about an internal longitudinal passage of the travel joint.

27. The system according to claim 24, wherein the third fiber optic line is coiled within a sidewall of the travel joint.

28. A system for completing a subterranean well, the system comprising:

a first assembly installed in a wellbore, the first assembly including a fluid loss control device and a first fiber optic line, the fluid loss control device being actuated to prevent flow through the device when a service tool is retrieved from the first assembly; and a second assembly installed in the wellbore and engaged with the first assembly, the second assembly including a second fiber optic line, in response to engagement between the first and second assemblies in the wellbore, the fluid loss control device permitting flow through the device, and the first and second fiber optic lines being operatively connected to each other.

29. The system according to claim 28, wherein the fluid loss control device is a valve which selectively prevents and permits flow through a longitudinal passage of the first assembly in communication with the wellbore external to the first assembly.

30. The system according to claim 28, wherein the fluid loss control device is a valve which selectively permits and prevents flow between a longitudinal passage of the first assembly and the wellbore external to the first assembly through a well screen of the first assembly.

31. The system according to claim 28, wherein the first assembly includes a well screen, the first fiber optic line extending longitudinally through the well screen.

32. The system according to claim 28, wherein the first assembly includes a packer, the first fiber optic line extending longitudinally through the packer.

33. The system according to claim 28, wherein the second assembly includes a travel joint, and wherein the second fiber optic line extends longitudinally through the travel joint.

34. The system according to claim 28, wherein each of the first and second assemblies includes an orienting device, the orienting devices rotationally orienting the first and second assemblies relative to each other when the second assembly is engaged with the first assembly.

35. The system according to claim 34, wherein each of the first and second fiber optic lines has a fiber optic connector operably coupled thereto, and wherein the orienting devices align the fiber optic connectors when the second assembly is engaged with the first assembly.

36. The system according to claim 28, wherein the fluid loss control device permits one-way flow through the device prior to engagement between the first and second assemblies in the wellbore.

* * * * *